US007928307B2

(12) United States Patent
Hetherington et al.

(10) Patent No.: US 7,928,307 B2
(45) Date of Patent: Apr. 19, 2011

(54) KARAOKE SYSTEM

(75) Inventors: Phil A. Hetherington, Port Moody (CA); Shree Paranjpe, Vancouver (CA)

(73) Assignee: QNX Software Systems Co., Ottawa, Ontario (CA)

( * ) Notice: Subject to any disclaimer, the term of this patent is extended or adjusted under 35 U.S.C. 154(b) by 146 days.

(21) Appl. No.: 12/264,190

(22) Filed: Nov. 3, 2008

(65) Prior Publication Data

US 2010/0107856 A1 May 6, 2010

(51) Int. Cl.
*G10H 1/00* (2006.01)

(52) U.S. Cl. ..... 84/600; 84/601

(58) Field of Classification Search ..... 84/600–602; 434/307 A

See application file for complete search history.

(56) References Cited

U.S. PATENT DOCUMENTS

| | | | | |
|---|---|---|---|---|
| 3,916,104 | A * | 10/1975 | Anazawa et al. | 381/26 |
| 5,428,708 | A * | 6/1995 | Gibson et al. | 704/270 |
| 5,541,359 | A * | 7/1996 | Lee | 84/645 |
| 5,649,019 | A * | 7/1997 | Thomasson | 381/83 |
| 5,876,213 | A * | 3/1999 | Matsumoto | 434/307 A |
| 6,744,974 | B2 * | 6/2004 | Neuman | 386/246 |
| 6,816,833 | B1 * | 11/2004 | Iwamoto et al. | 704/207 |
| 6,912,501 | B2 * | 6/2005 | Vaudrey et al. | 704/500 |
| 7,079,026 | B2 * | 7/2006 | Smith | 340/539.22 |
| 7,122,732 | B2 * | 10/2006 | Cho et al. | 84/617 |
| 7,337,111 | B2 * | 2/2008 | Vaudrey et al. | 704/225 |
| 2001/0008100 | A1 * | 7/2001 | Devecka | 84/738 |
| 2005/0140519 | A1 * | 6/2005 | Smith | 340/692 |
| 2006/0050894 | A1 * | 3/2006 | Boddicker et al. | 381/77 |
| 2006/0052167 | A1 * | 3/2006 | Boddicker et al. | 463/37 |
| 2007/0206929 | A1 * | 9/2007 | Konetski et al. | 386/96 |
| 2007/0218444 | A1 * | 9/2007 | Konetski et al. | 434/307 A |
| 2008/0134866 | A1 * | 6/2008 | Brown | 84/661 |
| 2009/0022330 | A1 * | 1/2009 | Haulick et al. | 381/57 |
| 2009/0038467 | A1 * | 2/2009 | Brennan | 84/609 |
| 2009/0104956 | A1 * | 4/2009 | Kay et al. | 463/7 |
| 2009/0165634 | A1 * | 7/2009 | Mahowald | 84/610 |
| 2009/0265164 | A1 * | 10/2009 | Yoon et al. | 704/200 |
| 2009/0304196 | A1 * | 12/2009 | Patton | 381/63 |
| 2009/0314154 | A1 * | 12/2009 | Esaki et al. | 84/611 |
| 2010/0014692 | A1 * | 1/2010 | Schreiner et al. | 381/119 |
| 2010/0107856 | A1 * | 5/2010 | Hetherington et al. | 84/610 |
| 2010/0300267 | A1 * | 12/2010 | Stoddard et al. | 84/610 |
| 2010/0304810 | A1 * | 12/2010 | Stoddard | 463/7 |
| 2010/0304812 | A1 * | 12/2010 | Stoddard et al. | 463/7 |

FOREIGN PATENT DOCUMENTS

| | | | |
|---|---|---|---|
| JP | 08103000 | A * | 4/1996 |
| JP | 2009147625 | A * | 7/2009 |
| JP | 2009150920 | A * | 7/2009 |

* cited by examiner

*Primary Examiner* — David S. Warren

(74) *Attorney, Agent, or Firm* — Brinks Hofer Gilson & Lione

(57) ABSTRACT

The system describes a karaoke system that enhances the experience of singing along with music, but without the need to display the lyrics. The system includes a combination of a vocal track reducer and an echo canceller, decision logic for determining when a person is talking or singing (double-talk detector) and a method for "ducking" (i.e., attenuating) the vocal track when the singing is detected. No special CD or DVD with lyric tracks is required, making the system capable of working with CD, mp3, AM, FM, HD radio, satellite radio signals, or any other suitable content source. The result is that any content source may potentially be used as a karaoke soundtrack without any pre-modification.

20 Claims, 3 Drawing Sheets

KARAOKE SYSTEM

BACKGROUND OF THE SYSTEM

Karaoke has proven to be a popular form of entertainment. Traditionally, karaoke is the performance of popular songs to a pre-recorded instrumental soundtrack (i.e. there are no lead vocals on the track). Often the lyrics of the song will be played along with the audio track, and will be highlighted or scrolled at the correct time and tempo to make it easier for the singer to follow along. Although generally done at a karaoke bar or at a party or other event, karaoke has grown in popularity in others venues, such as in automobiles (i.e. "in-car karaoke").

In-car karaoke is an extremely popular form of entertainment in Japan. Instead of just singing along to songs on the radio or in-car entertainment system, drivers will often playback karaoke tracks while driving and sing along. There are a number of disadvantages of in-car karaoke that have prevented it from penetrating the mainstream. One disadvantage is the potential distraction to the driver if there is a need to follow along with visually presented lyrics. For safety, it is important to minimize driver distraction during automobile operation. But without guide lyrics, it is often difficult for an amateur performer to properly follow along and sing at the right times and tempo.

Another disadvantage is the need to provide karaoke ready recordings for use in the car. Pre-recorded karaoke tracks are relatively expensive and must be compiled in some re-playable format and source (i.e. cd-rom, tape, mp3 player, etc.) to be available in a car. This requires advance preparation and can remove some of the spontaneity from enjoying in-car karaoke.

The driver can abandon prerecorded karaoke tracks, and sing along with music, whether from mp3, FM, CD, or satellite radio, but this is not quite the same as Karaoke. The vocals of the recorded artist can overwhelm the vocals of the karaoke singer and diminish the performance experience.

BRIEF SUMMARY OF THE SYSTEM

The system describes a karaoke system that enhances the experience of singing along with music, but without the need to display the lyrics. The system includes a combination of a vocal track reducer and an echo canceller, decision logic for determining when a person is talking or singing (double-talk detector) and a method for "ducking" (i.e., attenuating) the vocal track when the singing is detected. No special CD or DVD with lyric tracks is required, making the system capable of working with CD, mp3, AM, FM, HD radio, satellite radio signals, or any other suitable content source. The result is that any content source may potentially be used as a karaoke soundtrack without any pre-modification.

BRIEF DESCRIPTION OF THE DRAWINGS

The invention can be better understood with reference to the following drawings and description. The components in the Figures are not necessarily to scale, emphasis instead being placed upon illustrating the principles of the invention. Moreover, in the Figures, like reference numerals designate corresponding parts throughout the different views.

DETAILED DESCRIPTION OF THE SYSTEM

A simplified Karaoke system is provided where a singer sings along to pre-recorded music that already includes a vocal track. When the system is activated, the singer sings along to the music and the vocal track in the music is automatically attenuated whenever the person sings. As long as the person is singing, the automatic attenuation is invoked. If the person stops singing then the vocal track returns. In some cases, the system can give the impression that the singer is participating in a "duet" with the artist. The system also provides a method of teaching the lyrics to a song. While the person sings the artist is quiet, stepping in to help only when the person can not remember the words and is quiet.

In one embodiment, the system is envisioned as being implemented in an automobile setting. In this description the term "driver" can refer to person in the vehicle who is singing, which can be the actual driver of the vehicle or to anyone else in the vehicle who is singing. Although envisioned as being useful in an automobile setting, the system may also be implemented in any other setting as well, and can be useful in a home or commercial environment as desired.

Figure 2:
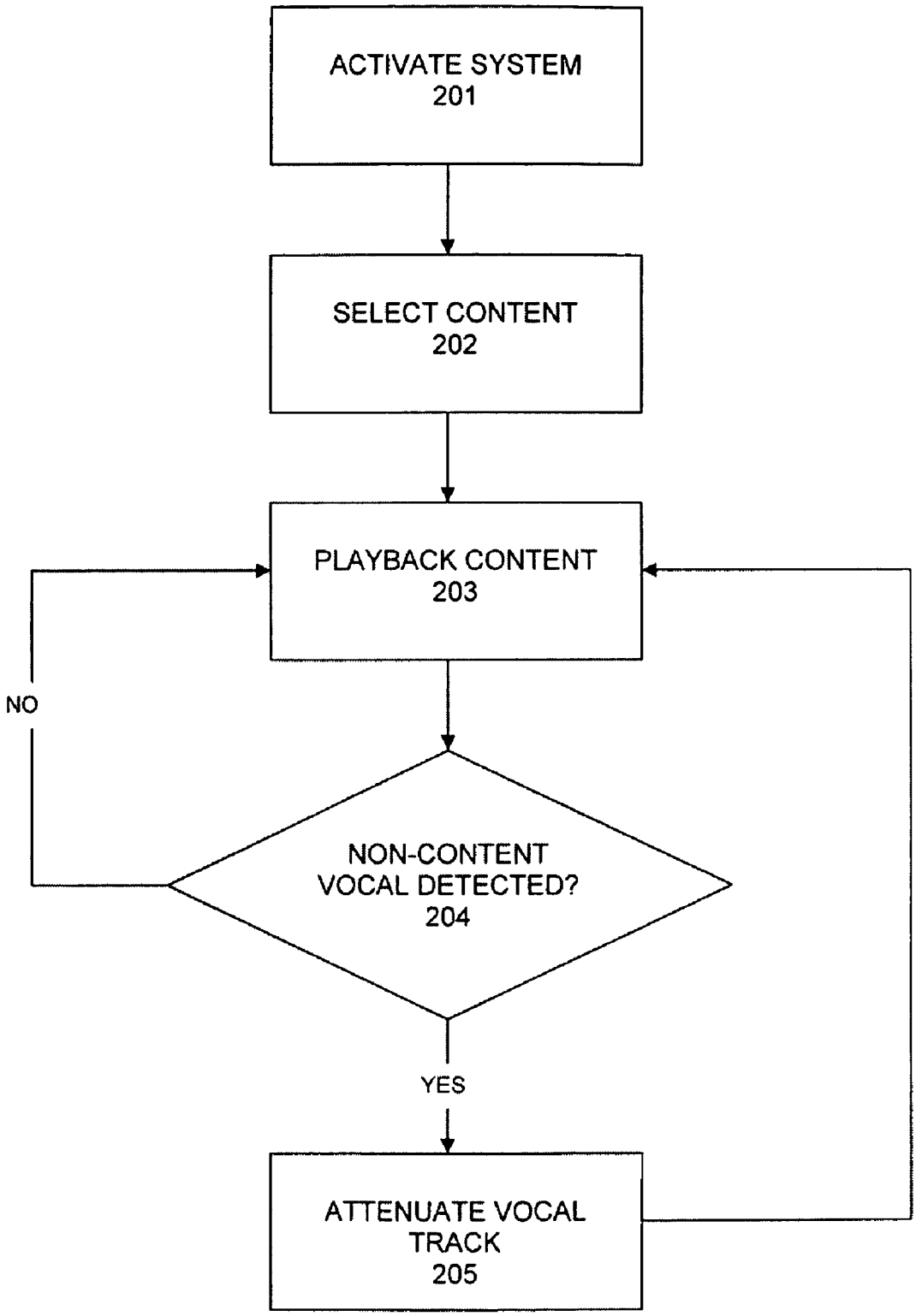
FIG. 2 is a flow diagram illustrating the operation of an embodiment of the system.

FIG. 2 is a flow diagram illustrating the operation of one embodiment of the system. At step 201 the system is activated. The system can either be operating or not operating at the discretion of the user. If the system is not active, the audio playback of content is normal, without any attenuation of the vocal track. In other words, the playback system operates as any typical playback system. At step 202 the user selects content to be played. This content may be from any source that they music system can access, including CDs, mp3s, AM, FM, HD radio, satellite radio signals, or any other suitable content source that can be played back to a user.

At step 203 the content playback begins. At decision block 204 the system determines if a live voice (non-content vocal source) is detected. For example, if the system is in a vehicle, the driver might be attempting to sing along with the content. In other embodiments, the driver and/or passengers may just be talking. The system checks at step 204 to determine if there is any vocal input from a non-content source.

If there is no detected non-content vocal source at step 204, the system simply continues with normal, non-attenuated playback at step 203, and continues checking for a non-content vocal source. If a non-content vocal source is detected at decision block 204, the system attenuates the vocal track of the pre-recorded content at step 205 and returns to step 203.

In one embodiment, the system only attenuates the pre-recorded vocal track when it detects a non-content vocal source. This means that between lines or verses of the pre-recorded content, when the driver isn't singing, the system returns to normal playback. This can assist a hesitant karaoke singer by playing the first word or words of the next line in a normal fashion if the driver/singer is not sure when to begin singing again, or what the words of the song are. This makes it easier for the driver/singer to follow along and to sing at the appropriate times.

In another embodiment, the system continuously provides attenuation throughout the duration of the pre-recorded song when it has detected a non-content vocal source, in the assumption that the driver/singer wishes to perform karaoke for the entirety of that content.

Non-Content Vocal Source Detection

As noted above, the system actively attenuates the vocal track of a content source when the system detects a non-content vocal source. In one embodiment, the system accomplishes this by detecting vocal energy above a threshold level on a microphone (such as a microphone in a vehicle). When vocal energy above the threshold is detected, the system attenuates the pre-recorded vocal track.

A microphone that is not directly in front of the person providing the non-content vocal source is called a "far-field" microphone. In other words, there is some distance between the singer and the microphone. In a vehicle for example, the microphone may be placed near the rear view mirror, or near a sun visor location. The use of a far-field microphone introduces particular energy detection problems. In particular, there are a number of audio energy sources in addition to the driver/singer that are detected by the microphone. For example, the pre-recorded music playing over the vehicle speakers is picked up by a far-field microphone at nearly the same energy as the would-be singer, making discrimination of the driver's voice and the pre-recorded music difficult. Discriminating between the signals using the power ratio is also difficult because the power ratio between the reference music and the microphone input can be significantly greater than or less than 1.0, so there is no set level of music expected on the microphone. A vehicle environment also includes a number of noise sources that are neither the singer nor the content. These noise sources include road and vehicle noise, wind noise, passenger chatter, cell phone ringing, climate control fans, and the like.

The system includes the ability to discriminate between sound sources so that a singer can be detected reliably and the operation of the system can be invoked appropriately. In one embodiment, the system uses a far-field echo canceller to remove the contribution of the music from the microphone channel and provide a reliable indicator of local voice presence to initiate attenuation of the song's vocal track.

Figure 1:
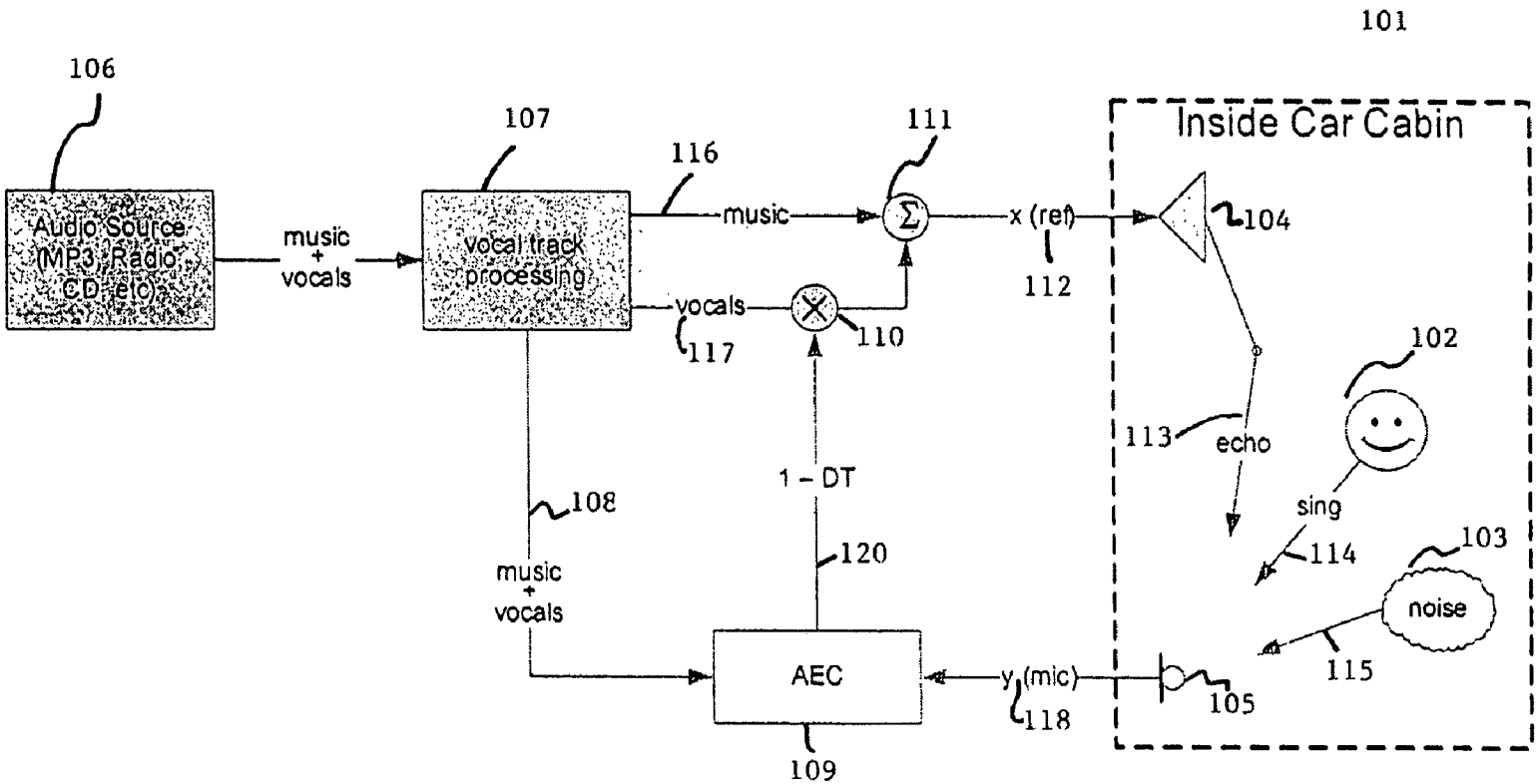
FIG. 1 is a block diagram of one embodiment of the system.

FIG. 1 illustrates a block diagram of an embodiment of the system as implemented in a vehicle. The content playback and processing system includes an audio source 106 providing content that includes music and vocals. This signal is provided to a vocal track processor 107. This unit processes the signal to separate the music 116 and vocal 117 signals using a number of known techniques. The vocal track processor outputs the music signal 116 to summing node 111 and the vocal signal to node 110. The output of node 110 is combined with music signal 116 at summing node 111 and provided as output 112 to vehicle cabin speaker 104 in cabin 101. Note that when there is no singer detected in the vehicle, the output of node 110 is simply the vocal signal 117 so that the signal 112 is the normal music plus vocal track.

The vocal track processor 107 also outputs the full music plus vocal signal 108 to Acoustic Echo Canceller (AEC) 109. The AEC 109 also receives input from cabin microphone 105. AEC 109 outputs a signal to node 110 that will modify (attenuate) the vocal signal 117 when a singer is detected so that the output 112 of summing node 111 will be the music signal 116 with attenuated vocal signal.

As can be seen at cabin 101, the microphone 105 receives sound signals from multiple sources, including speaker 104, singer 102, and noise 115 from noise sources 103. The speaker output 113 is an echo signal and the singers output 114 is the non-content vocal source to be detected.

Operation of Acoustic Echo Canceller (AEC)

The Acoustic Echo Canceller (AEC) 109 determines when the driver 102 (or other passengers if the car cabin 101 contains multiple microphones) is vocally active. In a car cabin 101, the microphone 105 is typically housed in the rear-view mirror (or some other "distant" location) and is considered "far away" from the driver's mouth. The microphone signal, y 118, consists of three signals: (1) an echo signal 113 which is the processed reference signal, x 112, emitted by the loudspeaker 104; (2) local noise 115 from the car cabin 101; (3) the driver/singer's voice 114. The AEC 109 compares the microphone signal 118 with the song's music signal 109 and determines if the driver 102 is vocally active during the song. In an acoustic echo cancellation system, this simultaneous vocal activity is referred to as "double talk" (DT). When active, the AEC 109 outputs signal 120 (which in one embodiment is 1-DT) to node 110. When there is double talk detected, the combination of signal 120 with vocal signal 117 at node 110 will result in attenuation of the vocal signal 117.

One aspect of the system is that it uses some of the AEC's analysis methods to attenuate the vocal track portion of the song. As the double talk level increases, the vocal track portion mixed into the reference signal, x, decreases, thereby "ducking" the song's vocals.

Figure 3:
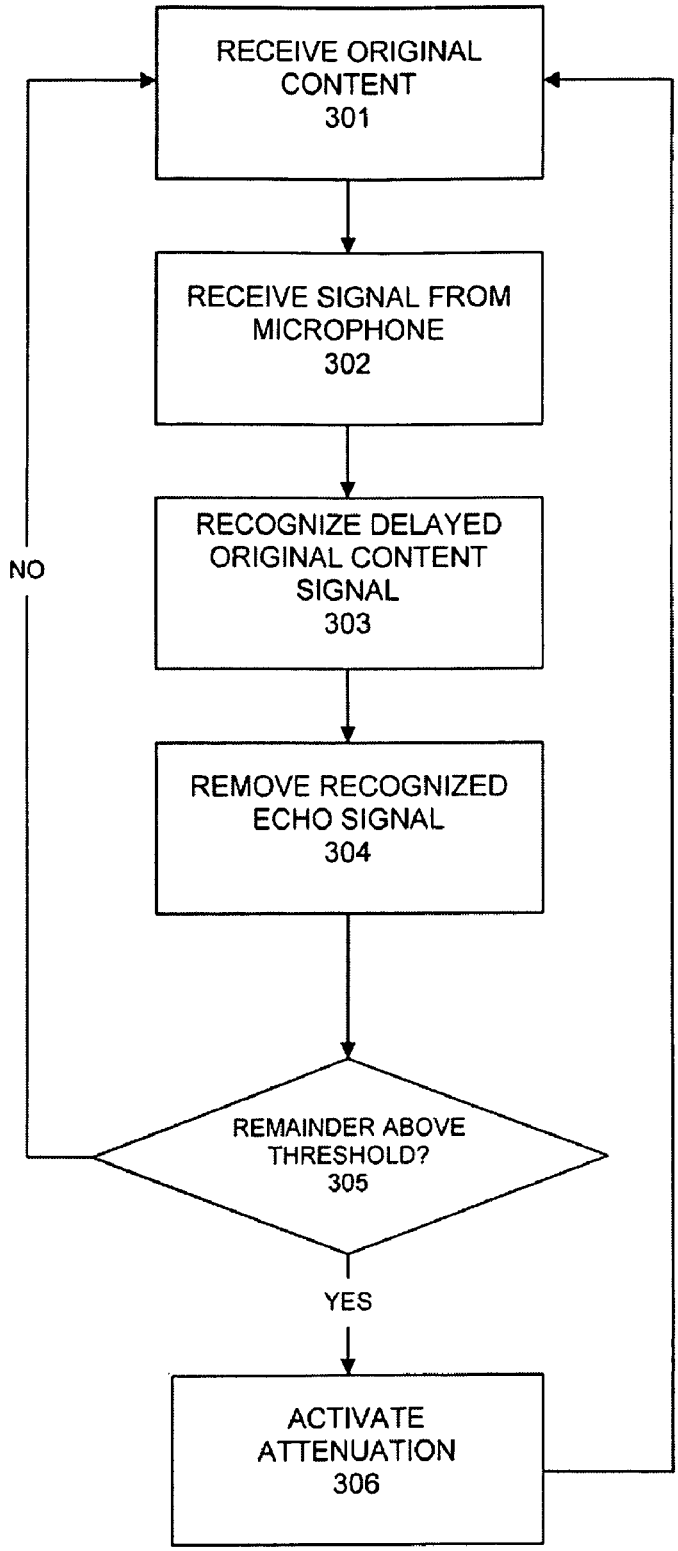
FIG. 3 is a flow diagram illustrating one embodiment for detecting the singer in the system.

FIG. 3 is a flow diagram illustrating the operation of AEC 109. At step 301 the AEC 109 receives the original content signal 108. At step 302 the AEC 109 receives the signal 118 from cabin microphone 118. At step 303 AEC 109 attempts to recognize the original signal 108 (with delay) in signal 118. At step 304 AEC 109 removes the recognized echo signal. This should result in the signal now just consisting of the non-content vocal signal 114 of the singer 102 and any noise 115. At decision block 305 the AEC 109 compares the remaining signal to a threshold reference. If the remaining signal is above the threshold, it is assumed that the driver/singer 102 is singing and attenuation of the vocal track is activated at step 306. If the signal is below the threshold, the system returns to step 301 for the next signal sample.

Vocal Track Processing

For Karaoke purposes, a song can be considered to be composed of two components: instrumental music 116 and vocals 117. Vocal track processing provides a real-time method to separate, and subsequently attenuate, the vocal component from the music of any song material, thereby eliminating the need to use pre-processed audio material that has already separated the vocals from the rest of the instrumental music. Vocal track processing allows the system to accept any audio source, such as a decoded MP3 stream, radio (AM/FM/Satellite), CD, or any other content source as its input. By using generally available audio sources instead of special CDs (or other audio formats) that have had their vocal tracks removed, the system does not require recurring costs for purchasing new material and is not limited to the selection of special Karaoke source material.

There are a number of known ways to attenuate vocals from a song. For a stereo (2 channel) track, one simple method is to simply subtract one channel from the other. For example, if an original 2-channel stereo recording's vocals were panned to the center, then the difference between the left and right channels (e.g., L-R or R-L) can reduce the vocal component. A slightly more complicated method filters/equalizes the signals before subtraction so that instrumental music is not as likely to be mistakenly removed. More sophisticated methods analyze the song content more closely by decomposing the input signal into frequency bands and calculating various measures, including the coherence between the left and right channels, to help further isolate the vocal track from the instrumental music. The system can utilize any current or future system for vocal track removal.

The application does not have to be Karaoke, but could just be a system for improving communication among people in a room. For example, a song could be played in a room, but the vocal track could be reduced any time someone talks so that communication is easier for people. Once the person stops talking, the vocal track in the song comes back full. Such a system could also improve in-car communication among vehicle occupants.

The illustrations have been discussed with reference to functional blocks identified as modules and components that are not intended to represent discrete structures and may be combined or further sub-divided. In addition, while various embodiments of the invention have been described, it will be apparent to those of ordinary skill in the art that other embodiments and implementations are possible that are within the scope of this invention. Accordingly, the invention is not restricted except in light of the attached claims and their equivalents.

The invention claimed is:

1. An apparatus comprising:

an audio source;

a vocal track processor coupled to the audio source that outputs first and second signals, where the first signal comprises a music track of the audio source and the second signal comprises a vocal track of the audio source;

a microphone; and an acoustic echo canceller coupled to the microphone and the vocal track processor, wherein the acoustic echo canceller is configured to receive a microphone signal from the microphone, and wherein the acoustic echo canceller is configured to attenuate the vocal track in response to a determination that a vocal content level of the microphone signal is above a predetermined threshold.

2. The apparatus of claim 1 wherein the acoustic echo canceller outputs a third signal.

3. The apparatus of claim 2 further including a first node coupled to the second and third signals, the first node providing a fourth signal based on the second and third signals.

4. The apparatus of claim 3 further including a second node coupled to the first signal and the fourth signal and providing a fifth signal that comprises a sum of the first and fourth signals.

5. The apparatus of claim 4 further including a speaker coupled to the fifth signal.

6. The apparatus of claim 3 wherein the first node attenuates the vocal track based on the third signal received from the acoustic echo canceller.

7. The apparatus of claim 1 further comprising an output node configured to output a combination of the music track and the vocal track to a speaker system in response to a determination that the vocal content level of the microphone signal is below the predetermined threshold.

8. The apparatus of claim 7 wherein the output node is configured to output the music track to the speaker system without the vocal track in response to the determination that the vocal content level of the microphone signal is above the predetermined threshold.

9. The apparatus of claim 7 wherein the output node is configured to output a combination of the music track and an attenuated version of the vocal track to the speaker system in response to the determination that the vocal content level of the microphone signal is above the predetermined threshold.

10. The apparatus of claim 1 wherein the acoustic echo canceller is configured to remove a portion of the microphone signal that originates from the acoustic source to leave a remainder signal, and wherein the acoustic echo canceller is configured to output an attenuation signal to an attenuation node coupled with the vocal track in response to a determination that the vocal content level in the remainder signal is above the predetermined threshold.

11. A method for attenuating vocal content from an audio source comprising:

receiving original audio content comprising a music track and a vocal track;

receiving a signal from a microphone;

identifying a delayed original content signal in the signal from the microphone;

removing the identified signal from the original audio content at an acoustic echo canceller to identify a remainder signal; and attenuating the vocal track in response to a determination that a vocal content level of the remainder signal is above a predetermined threshold.

12. The method of claim 11 further comprising providing the signal from the microphone to the acoustic echo canceller.

13. The method of claim 12 further comprising providing the original audio content to the acoustic echo canceller.

14. The method of claim 11 further comprising comparing the remainder signal to the predetermined threshold to determine whether the remainder signal includes live voice.

15. The method of claim 14 further comprising enabling attenuation of the vocal track when the remainder signal is above the predetermined threshold.

16. The method of claim 11 further comprising outputting a combination of the music track and the vocal track without attenuation to a speaker system in response to a determination that the vocal content level of the remainder signal is below the predetermined threshold.

17. The method of claim 16 further comprising outputting the music track to the speaker system without the vocal track in response to the determination that the vocal content level of the remainder signal is above the predetermined threshold.

18. The method of claim 16 further comprising outputting a combination of the music track and an attenuated version of the vocal track to the speaker system in response to the determination that the vocal content level of the microphone signal is above the predetermined threshold.

19. An apparatus comprising:

a first signal input configured to receive a pre-recorded audio signal that comprises a music portion and a vocal portion;

a vocal track processor coupled with the first signal input and configured to separate the music portion into a first signal and the vocal portion into a second signal;

a second signal input configured to receive a microphone signal;

an acoustic echo canceller coupled with the second signal input and configured to compare a vocal content level of the microphone signal with a predetermined threshold; and an output node configured to output a combination of the first signal and the second signal to a speaker system in response to a determination by the acoustic echo canceller that the vocal content level of the microphone signal is below the predetermined threshold, wherein the output node is configured to output the first signal to the speaker system without the second signal or with an attenuated version of the second signal in response to a determination that the vocal content level of the microphone signal is above the predetermined threshold.

20. The apparatus of claim 19 wherein the acoustic echo canceller is configured to remove a portion of the microphone signal that originates from the pre-recorded audio signal to leave a remainder signal, and wherein the acoustic echo canceller is configured to output an attenuation signal to an attenuation node coupled with the second signal in response to the determination that the vocal content level of the microphone signal is above the predetermined threshold.

* * * * *